US007126071B1

(12) United States Patent
Yang et al.

(10) Patent No.: US 7,126,071 B1
(45) Date of Patent: Oct. 24, 2006

(54) KEY AND INPUT DEVICE CONTAINING THE KEY

(75) Inventors: Chun-Fei Yang, Taipei Hsien (TW); Cheng-Hsing Liu, Taipei Hsien (TW); Chang-Ming Shen, Taipei Hsien (TW); Chi-Fu Ho, Taipei Hsien (TW)

(73) Assignee: Wistron Corp., Taipei Hsien (TW)

( * ) Notice: Subject to any disclaimer, the term of this patent is extended or adjusted under 35 U.S.C. 154(b) by 0 days.

(21) Appl. No.: 11/430,922

(22) Filed: May 10, 2006

(30) Foreign Application Priority Data

Jan. 3, 2006 (TW) ..... 95100250 A

(51) Int. Cl.
*H01H 13/70* (2006.01)

(52) U.S. Cl. ..... 200/344

(58) Field of Classification Search ..... 200/5 A, 200/517, 296, 341–345; 341/22; 345/156, 345/160, 163, 168, 169; 400/490–496
See application file for complete search history.

(56) References Cited

U.S. PATENT DOCUMENTS 5,668,358 A * 9/1997 Wolf et al. ..... 200/345
5,823,325 A * 10/1998 Lin ..... 200/344
6,100,482 A * 8/2000 Koma et al. ..... 200/344
6,239,391 B1 * 5/2001 Nishijima et al. ..... 200/344
6,509,536 B1 * 1/2003 Sasaki ..... 200/344
6,615,453 B1 * 9/2003 Lin ..... 200/344
6,713,699 B1 * 3/2004 Yoneyama ..... 200/344
6,815,627 B1 * 11/2004 Chen ..... 200/344

* cited by examiner

*Primary Examiner*—Michael A. Friedhofer
(74) *Attorney, Agent, or Firm*—Troxell Law Office, PLLC

(57) ABSTRACT

A key, which is pressed for constituting close circuit, includes a key cap, a movable arm and a bottom plate. A bottom of the key cap is joined to a bend part of the movable arm. A pivot part of the movable arm is movably joined to a pivot hole of the bottom plate. The bend part surrounds at least two adjacent lateral sides of the bottom of the key cap to constitute a support plane. When the key cap is pressed down at any one spot on the key cap, the pressing force is supported by the bend part and moves the key cap downward directly instead of inclining to the side of the pressed spot. The key provides simple structure for easy assembly and requires less precision for saving fabrication cost.

19 Claims, 4 Drawing Sheets

KEY AND INPUT DEVICE CONTAINING THE KEY

BACKGROUND OF THE INVENTION

1. Field of the Invention

The present invention is related to an input device of an electronic apparatus and particularly to a key with larger area in an input device.

2. Brief Description of Related Art

U.S. Pat. No. 6,318,695 discloses a notebook computer key, which includes a key hat, a supporting frame and an elastic touch moving piece. Both the supporting frame and the elastic touch moving piece are joined to the bottom side of the key hat. Further, a printed circuit board is disposed under the supporting frame. The elastic touch moving piece is pressed down by the key hat to become deformed and move downward. In this way, the internal conductive part contacts the printed circuit board to constitute close circuit.

Taiwanese Patent No. 232398 discloses a key structure, which is attached to a case member with at least an opening, and the key structure includes at least a key part. The key part further includes a first part and a second part. The first part is fixedly joined to the case member and the second part conceals the opening. A support frame is disposed at the opening and attached to the case member to face the second part. A switch unit is provided in the case member. When the user exerts a press force to the support frame, the support frame touches and moves the switch unit.

Referring to FIG. 1, for a key 50 without the support frame and especially providing a press part 51 with larger area, when the user presses a lateral side of the press part 51 with a finger 60 instead of pressing at a position corresponding to the top of the movable part 521 of the switch unit 52, the press part 51 becomes inclining downward with the movable part 521 as a fulcrum from the pressed spot and it results in insufficient downward displacement of the movable part 521 such that function of the switch is incapable of performed effectively. In order to overcome the problem, a plurality of switch units have to be placed under the press part 51 to avoid the press part 51 pressing the switch unit 52 under a condition of inclining. Another way to overcome the preceding problem is the supporting frame disclosed in the preceding U.S. Pat. No. 6,318,695. However, the supporting frame is complicated in structure, which increases costs of design and production.

SUMMARY OF THE INVENTION

An object of the present invention is to provide a key and an input device containing the key with simple structure, easy assembly and economical fabrication cost.

Another object of the present invention is to provide a key and an input device containing the key with which the structure thereof can be simplified to meet less strict requirement of precision for production.

A key according to the present invention is pressed for constituting close circuit, comprising: a key cap; a movable arm providing a bend part at a first end of a main part of the movable arm and a first pivot part inclining an angle at a second end of the main part of the movable arm; and an object, providing a second pivot part; wherein, a bottom of the key cap is joined to the bend part; the first pivot part is movably joined to the second pivot part; and the bend part surrounds the bottom of key cap at least two adjacent sides to constitute a support plane; whereby, when the key cap is pressed down at any one spot on the key cap, the pressing force is supported by the bend part and moves the key cap downward directly instead of inclining to the side of the pressed spot. The key provides simple structure for easy assembly and requires less precision for saving fabrication cost.

BRIEF DESCRIPTION OF THE DRAWINGS

The present invention can be more fully under-stood by reference to the following description and accompanying drawings, in which.

DETAILED DESCRIPTION OF THE INVENTION

Figure 1:
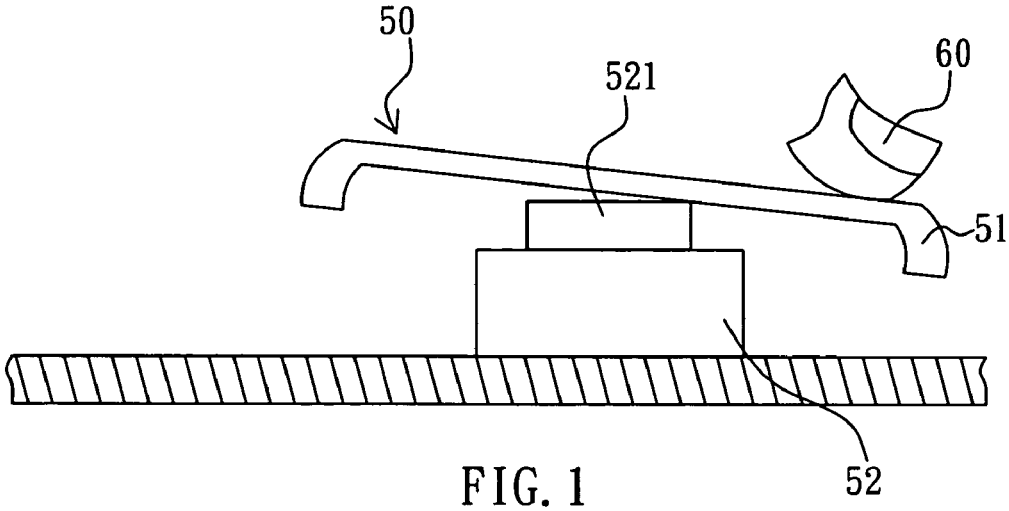
FIG. 1 (PRIOR ART)
FIG. 1 is a side elevational view illustrating a conventional key with a large press part being pressed down.
Figure 2:
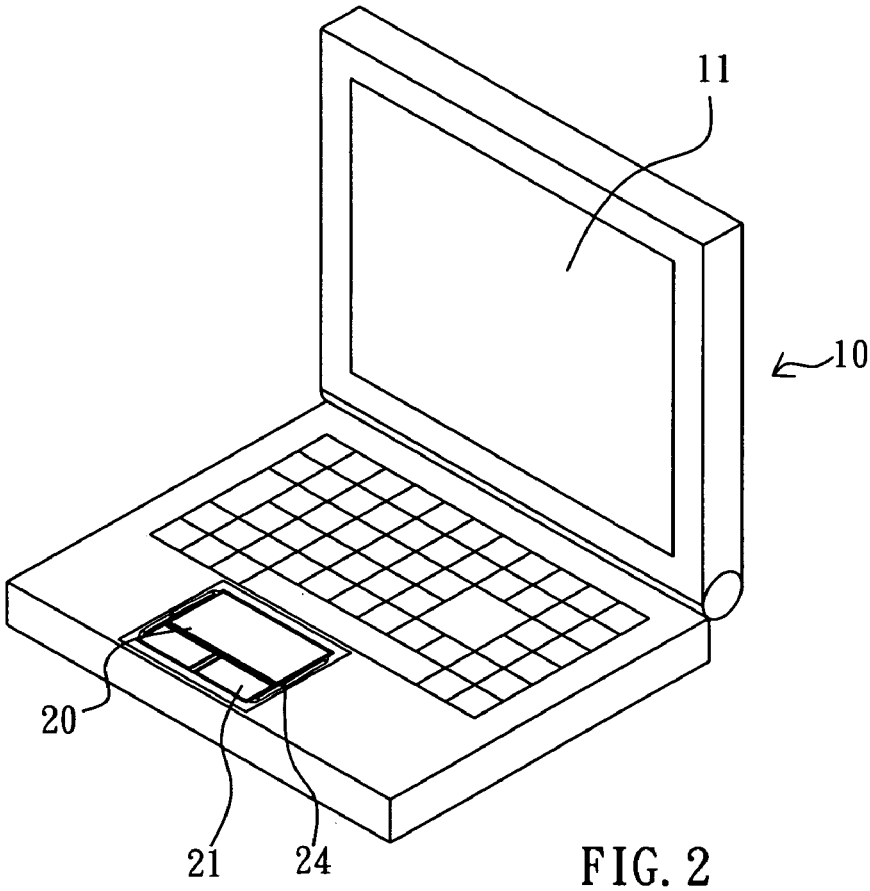
FIG. 2 is a perspective view of a laptop computer associated with a key module according to the present invention.
Figure 3:
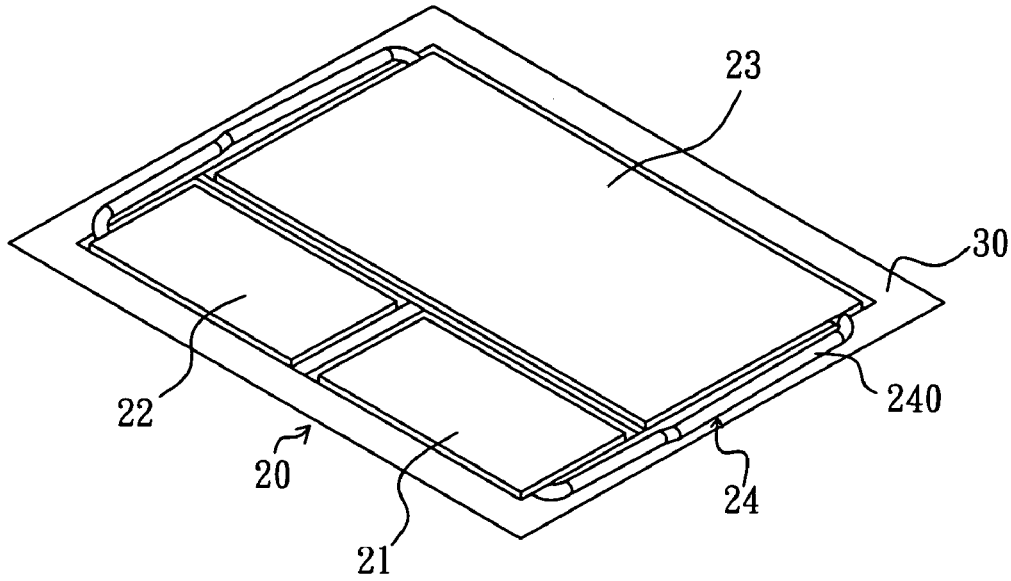
FIG. 3 is a perspective view of a preferred embodiment of an input device according to the present invention.

Referring to FIGS. 2 and 3, a preferred embodiment of a key associated with an input device according to the present invention is a key 21 of a touch board module 20 in a laptop computer 10. The touch board module 20 includes keys 21, 22 and a touch zone 23. The touch board module 20 provides a function the same as the conventional touch board module for the user operating the cursor to move on the screen 11 with the touch zone 23 and outputting signal with the keys 21, 22.

Figure 4A:
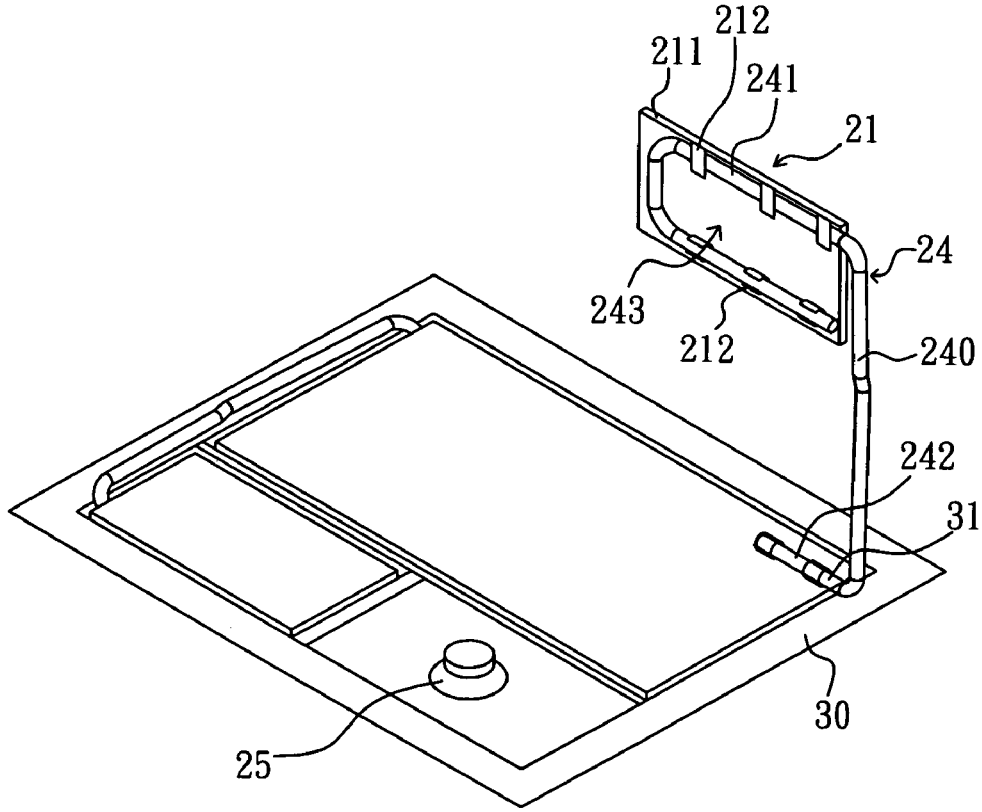
FIG. 4A is a perspective view of a preferred embodiment of a key with a key cap being lifted according to the present invention.
Figure 4B:
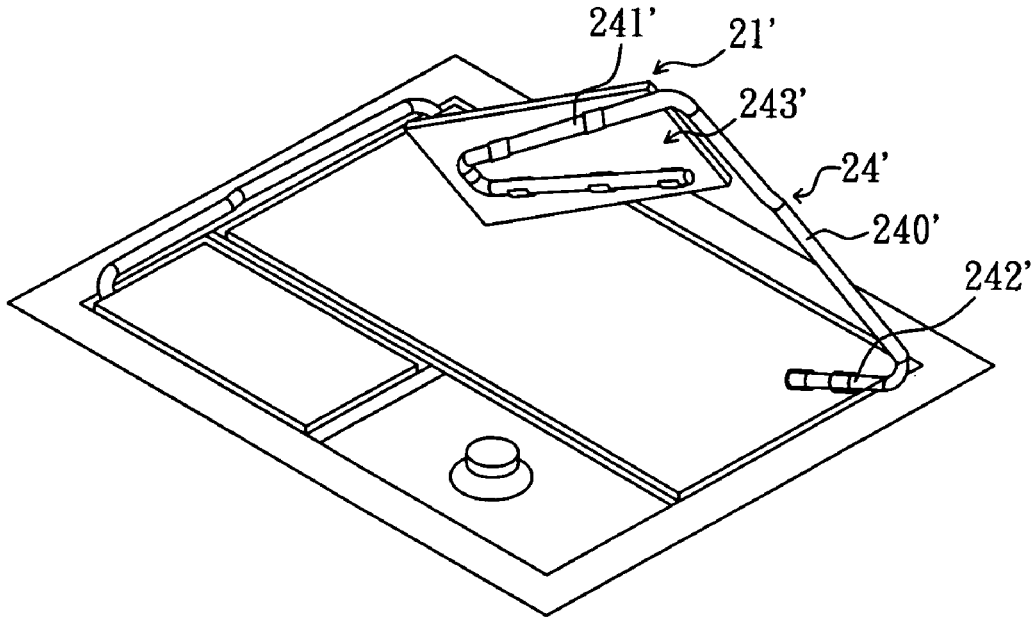
FIGS. 4B and 4C are perspective views illustrating another two preferred embodiments of the key with a key cap thereof being lifted respectively.
Figure 4C:
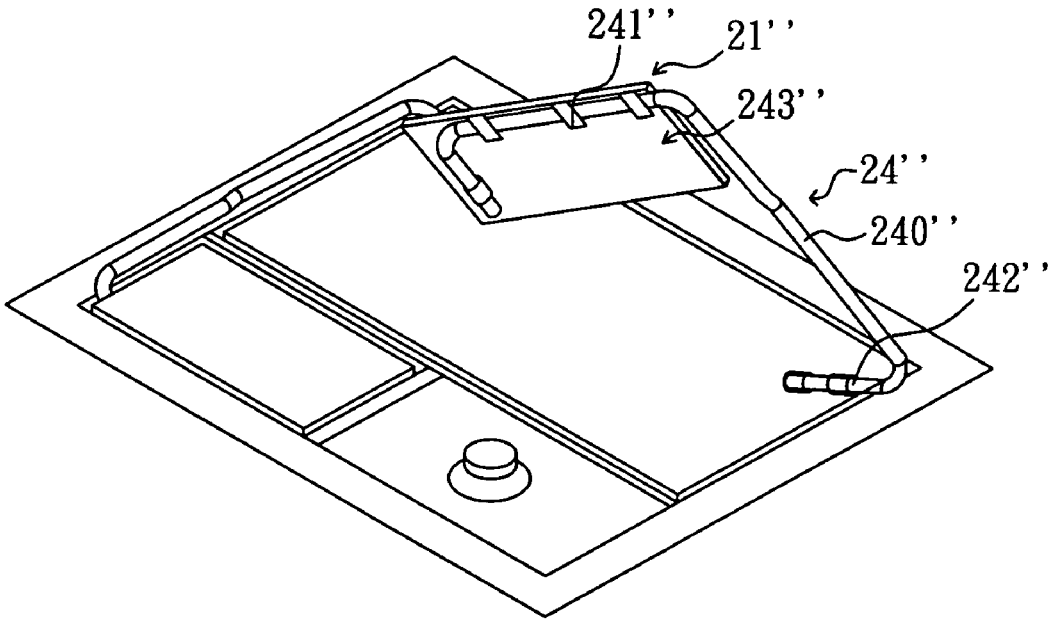
Figure 5:
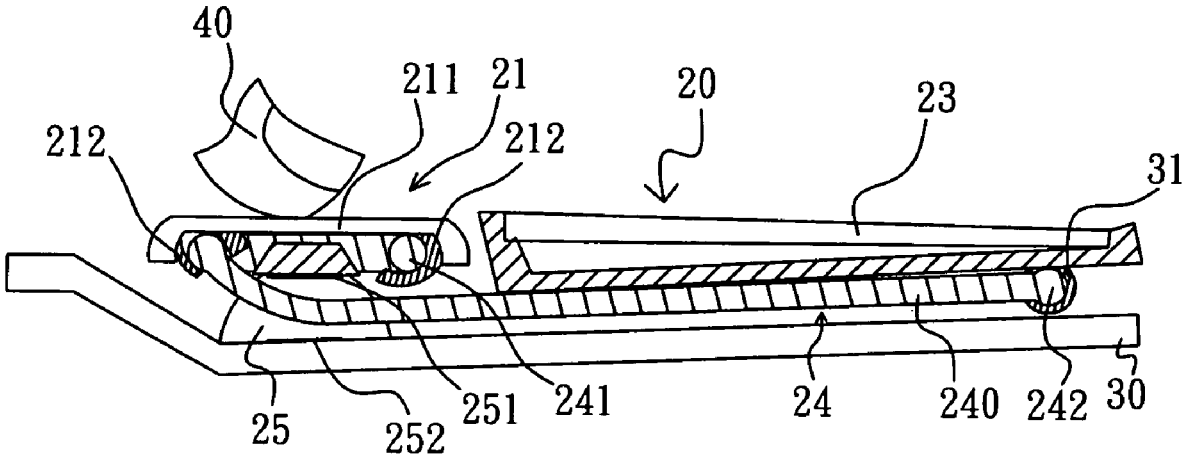
FIG. 5 is a sectional view illustrating the key of the invention in use.

Referring to FIGS. 3, 4A, 4B, 4C and 5, the key 21 includes a key cap 211 and a movable arm 24. A plurality of engaging members 212 are provided at the bottom side of the key cap 211. The engaging members 212 each have at least a holding arm. The movable arm 24 has a bend part 241 at an end of a main part 240 of the movable arm 24 as shown in FIG. 4A. The bend part 241 extends to a lateral side of the main part 240 of the movable arm 24 perpendicularly. Alternatively, the movable arm 24' shown in FIG. 4B or the movable arm 24" shown in FIG. 4C has a bend part 241' or a bend part 241" extends an inclining angle with a main part 240' or 240" of the movable arm 24' or 24" from an end thereof instead of the bend part 241. Another end of the movable arm 24 has a pivot part 242 as shown in FIG. 4A. The pivot part 242 extends to a lateral side of the main part 240 of the movable arm 24 perpendicularly. Alternatively, the movable arm 24' shown in FIG. 4B and the movable arm 24" shown in FIG. 4C each have a pivot part 242' and a pivot part 242" extends an inclining angle from another end of the main part 240' or 240" of the movable arm 24' and the movable arm 24" respectively instead of the pivot part 242 from the main part 240 of the movable arm 24. The engaging members 212 under the key cap 211 engage with the bend part 241 of the movable arm 24 and the pivot part 242 is movably joined to an object such as a pivotal hole 31 of a bottom plate 30. The bottom plate 30 is disposed under the movable arm 24 and can be either a hard circuit board or a soft circuit board. The bend part 241 of the movable arm 24 extends around at least two adjacent lateral sides of the bottom side of the key cap 211. For instance, the bend part 241 surrounds three lateral sides of the bottom side of the key cap 211 as shown in FIG. 4A to constitute a support plane 243 for the key cap 211. The bent part 241' of the movable arm 24' shown in FIG. 4B surrounds three adjacent lateral sides of the bottom side of the key cap 211' to constitute a "V" shaped support plane 243' for the key cap 211'. The bent part 241" of the movable arm 24" shown in FIG. 4C surrounds two adjacent lateral sides of the bottom side of the key cap 211" to constitute an "L" shaped support plane 243" for the key cap 211". A switch unit 25 is placed under the key cap 211. The switch unit 25 in the present embodiment is made of rubber with a shape of hollow cone and an upper inner end thereof has a conductive part 251 as shown in FIG. 5. The conductive part 251 can be a membrane formed by conductive graphite, a conductive plate made of conductive material or a conductive rubber membrane. The conductive rubber membrane is a mixture of high molecular polymer of rubber and conductive micro particles.

The movable arm 24 with the bent part 241 forming a support plane 243 for supporting the key cap 211 from the bottom thereof is a special design for that once the user pressing down any position of the top of the key cap 211, the bend part 241 is capable of moving downward to allow the whole key cap 211 moving downward and pressing the switch unit 25 such that the conductive part 251 in the switch unit 25 touches the conductive part 252 underneath to form close circuit.

As the foregoing, the bend part 241 of the movable arm 24 is joined to the bottom of the key cap 211 to support the key cap 211 and when the key cap 211 is pressed down by a finger 40 of the user at any one spot on the key cap 211, the pressing force is supported by the bend part 241 and moves the bend part 241 downward. Due to the bottom of the key cap 211 being supported by the bend part 241, the key cap 211 moves downward directly instead of inclining to a lateral side of the pressed spot with the switch unit 25 as a fulcrum. In this way, the switch unit 25 is capable of being pressed down effectively such that it is not necessary to arrange a plurality of switch units 25 under a large area key or providing a complicatedly structural support frame at the bottom thereof and it is convenient for the switch unit being disposed at a proper position under the key cap 211.

Hence, it is appreciated that the present invention only provides a single movable arm 24 for the key cap 211 being pressed down horizontally. Comparing to the prior art, the support frame is simplified in structure greatly such that less strict precision is required and assembly is easy for saving production cost.

Furthermore, the key is suitable for an input device with keys thereof in large area such as the key in a touch board module on laptop computer or the big keys in an ordinary keyboard and the game player.

While the invention has been described with referencing to a preferred embodiment thereof, it is to be understood that modifications or variations may be easily made without departing from the spirit of this invention, which is defined by the appended claims.

What is claimed is:

1. A key, which is pressed for constituting close circuit, comprising:

a key cap;

a movable arm providing a bend part at a first end of a main part of the movable arm and a first pivot part inclining an angle at a second end of the main part of the movable arm; and an object, providing a second pivot part;

wherein, a bottom of the key cap is joined to the bend part; the first pivot part is movably joined to the second pivot part; and the bend part surrounds the bottom of the key cap on at least two adjacent sides to constitute a support plane;

whereby, when the key cap is pressed down at any one spot on the key cap, the pressing force is supported by the bend part and moves the key cap downward directly instead of inclining to the side of the pressed spot.

2. The key as defined in claim 1, wherein a plurality of engaging members are disposed at the bottom of the key cap to join with the bend part.

3. The key as defined in claim 2, wherein the engaging members are at least one holding arm.

4. The key as defined in claim 1, further comprising a switch unit disposed under the key cap.

5. The key as defined in claim 4, wherein the switch unit is made of rubber and shaped as a hollow cone with an inner upper end having a conductive part.

6. The key as defined in claim 1, wherein the bend part surrounds at least three adjacent lateral sides of the bottom of the key cap.

7. The key as defined in claim 1, wherein the first pivot part is perpendicular to the second end of the main part of the movable arm.

8. The key as defined in claim 1, wherein the object is a bottom plate disposed under the movable arm.

9. The key as defined in claim 8, wherein the second pivot part at the bottom plate is a pivot hole for receiving the first pivot part.

10. An input device, which is for transmitting control signal to an electronic device, comprising at least the key recited in claim 1.

11. The input device as defined in claim 10, wherein a touch board module of a laptop computer is the input device.

12. The input device as defined in claim 10, wherein the bottom of the key cap has a plurality of engaging members for joining with the bend part of the movable arm.

13. The input device as defined in claim 10, wherein the engaging members are at least one holding arm.

14. The input device as defined in claim 10, further comprising a switch unit disposed under the key cap.

15. The input device as defined in claim 14, wherein the switch unit is made of rubber and shaped as a hollow cone with an inner upper end having a conductive part.

16. The input device as defined in claim 10, wherein the bend part surrounds at least three adjacent lateral sides of the bottom of the key cap.

17. The input device as defined in claim 10, wherein the first pivot part is perpendicular to the second end of the main part of the movable arm.

18. The input device as defined in claim 10, wherein the object is a bottom plate disposed under the movable arm.

19. The input device as defined in claim 18, wherein the second pivot part at the bottom plate is a pivot hole for receiving the first pivot part.

* * * * *